US005414923A

United States Patent [19]

Thomas et al.

[11] Patent Number: 5,414,923

[45] Date of Patent: * May 16, 1995

[54] METHOD AND APPARATUS FOR INTERMEDIATE THICKNESS SLAB CASTER AND INLINE HOT STRIP AND PLATE LINE

[75] Inventors: John E. Thomas; George W. Tippins, both of Pittsburgh, Pa.

[73] Assignee: Tippins Incorporated, Pittsburgh, Pa.

[ * ] Notice: The portion of the term of this patent subsequent to Jan. 11, 2011 has been disclaimed.

[21] Appl. No.: 123,149

[22] Filed: Sep. 20, 1993

Related U.S. Application Data

[63] Continuation of Ser. No. 881,615, May 12, 1992.

[51] Int. Cl.[6] ..... B21B 1/00; B21B 13/22

[52] U.S. Cl. ..... 29/527.7; 29/33 C; 29/DIG. 5; 72/202; 72/229

[58] Field of Search ..... 29/33 C, 527.7, DIG. 5; 72/202, 229

[56] References Cited

U.S. PATENT DOCUMENTS 4,229,878 10/1980 Ushijima .
4,503,697 3/1985 Tippins et al. .
4,630,352 12/1986 Ginzburg et al. .
4,698,897 10/1987 Frommann et al. .
4,793,169 12/1988 Ginzburg .
4,958,677 9/1990 Kimura .
5,150,597 9/1992 Sekiya et al. .

*Primary Examiner*—Carl J. Arbes
*Attorney, Agent, or Firm*—Webb Ziesenheim Bruening Logsdon Orkin & Hanson

[57] ABSTRACT

A method and apparatus of making coiled plate, sheet in coiled form or discrete plate. The apparatus is an intermediate thickness slab caster and inline hot strip and plate line. The apparatus includes a continuous strip caster forming a strand of between about 3.5 and 5.5 inches thick; a shear for cutting the strand into a slab of desired length; a slab table including a slab takeoff operable transverse of the conveyor table; a slab collection and storage area adjacent to the slab conveyor table adapted to receive slab from the slab takeoff; a reheat furnace having an entry inline with both the slab conveyor table and the slab collection and storage area for receiving slabs from either; a feed and run back table at the exit of the reheat furnace; a hot reversing mill for reducing the slab to a thickness sufficient for coiling in a minimum number of flat passes; a pair of coiler furnaces located on opposite sides of the hot reversing mill; and a finishing line downstream of the pair of coiler furnaces.

15 Claims, 3 Drawing Sheets

METHOD AND APPARATUS FOR INTERMEDIATE THICKNESS SLAB CASTER AND INLINE HOT STRIP AND PLATE LINE

This is a continuation of copending application Ser. No. 07/881,615 filed on May 12, 1992.

FIELD OF THE INVENTION

This invention relates to the continuous casting and rolling of slabs and more particularly to an integrated intermediate thickness caster and a hot reversing mill.

BACKGROUND OF THE INVENTION

Since the advent of the continuous casting of slabs in the steel industry, companies have been trying to marry the hot strip mill to the continuous caster through an inline arrangement so as to maximize production capability and minimize the equipment and capital investment required. The initial efforts in this regard consisted of integrating continuous casters producing slabs on the order of 6 inches to 10 inches with existing continuous or semi-continuous hot strip mills. These existing hot strip mills included a reheat furnace, a roughing train (or a reversing rougher) and a six or seven stand finishing mill with a capacity of 1½ to 5 million tons per year. This mill arrangement is the present day design of large steel company mills and it is unlikely that new hot strip mills of this design would ever be built due to the high capital cost. However, the quest for low cost integrated caster-hot strip mills is not solved by current designs. Further, such prior art integrated mills were extremely inflexible as to product mix and thus market requirements.

These difficulties gave rise to the development of the so-called thin slab continuous hot strip mill which typically produces 1,000,000 tons of steel per year as specialized products. These mills have been integrated with thin slab casters on the order of 2 inches or less. Such integrated thin slab casters are enjoying increased popularity but are not without serious drawbacks of their own. Significant drawbacks include the quality and quantity limitations associated with the so-called thin slab casters. Specifically, the trumpet type mold necessary to provide the metal for the thin slab can cause high frictional forces and stresses along the surface of the thin wall slab which leads to poor surface quality in the finished product. Further, the 2 inch strip casters are limited to a single tundish life of approximately 7 heats because of the limited metal capacity of the mold.

Most importantly, the thin casters by necessity have to cast at high speeds to prevent the metal from freezing in the current ladle arrangements. This, in turn, requires the tunnel furnace which is just downstream of the slab caster to be extremely long, often on the order of 500 feet, to accommodate the speed of the slab and still be able to provide the heat input to a thin slab (2 inches) which loses heat at a very high rate. Since the slab also leaves the furnace at a high speed, one needs the multistand continuous hot strip mill to accommodate the rapidly moving strip and roll it to sheet and strip thicknesses. However, such a system is still unbalanced at normal widths since the caster has a capacity of about 800,000 tons per year and the continuous mill has a capacity of 2.4 million tons/year. The capital cost then approaches that of the earlier prior art systems that it was intended to replace.

In addition, the scale loss as a percentage of slab thickness is substantial for the 2 inch thin cast slab. Because of the extremely large furnace, one must provide a long roller hearth which becomes very maintenance intensive because of the exposed rotating rollers.

The typical multistand hot strip mill likewise requires a substantive amount of work in a short time which must be provided for by larger horsepower rolling stands which, in some cases, can exceed the energy capabilities of a given area, particularly in the case of emerging countries. Thin slab casters likewise are limited as to product width because of the inability to use vertical edgers on a 2 inch slab. In addition, such casters are currently limited to a single width. Further problems associated with the thin strip casters include the problems associated with keeping the various inclusions formed during steelmaking away from the surface of the thin slab where such inclusions can lead to surface defects if exposed. In addition, existing systems are limited in scale removal because thin slabs lose heat rapidly and are thus adversely effected by the high pressure water normally used to break up the scale.

In addition, this thin strip process can only operate in a continuous manner, which means that a breakdown anywhere in the process stops the entire line often causing scrapping of the entire product then being processed.

It is an object of our invention to integrate an intermediate thickness slab caster with a hot reversing mill. It is a further object to adopt a system which balances the rate of the caster to the rate of the rolling mill. It is also an object of our invention to adopt a system using less thermal and electrical energy. It is still a further object to adopt an automated system with small capital investment, reasonable floor space requirements, reasonably powered rolling equipment and low operating costs.

SUMMARY OF THE INVENTION

Our invention provides for a versatile integrated caster and mini-mill capable of producing on the order of 650,000 finished tons a year and higher. Such a facility can produce product 24" to 120" wide and can routinely produce a product of 800 PIW with 1000 PIW being possible. This is accomplished using a casting facility having a fixed and adjustable width mold with a straight rectangular cross section without the trumpet type mold. The caster has a mold which contains enough liquid volume to provide sufficient time to make flying tundish changes, thereby not limiting the caster run to a single tundish life. Our invention provides a slab approximately twice as thick as the thin cast slab thereby losing much less heat and requiring a lesser input of Btu's of energy. Our invention provides a slab having a lesser scale loss due to reduced surface area per volume and permits the use of a reheat or equalizing furnace with minimal maintenance required. Further, our invention provides a caster which can operate at conventional caster speeds and conventional descaling techniques. Our invention provides for the selection of the optimum thickness cast slab to be used in conjunction with a hot reversing mill providing a balanced production capability. Our invention has the ability to separate the casting from the rolling if there is a delay in either end. In addition, our invention provides for the easy removal of transitional slabs formed when molten metal chemistry changes or width changes are made in the caster.

All of the above advantages are realized while maintaining the advantages of a thin caster which include low ferrostatic head, low weight of slab, straight molds, shorter length molds, smaller required mold radius, low cooling requirements, low burning costs or shear capacity, and simplified machine constructions.

Our invention provides an intermediate thickness slab caster integrated with a hot strip and plate line which includes a reheat or equalizing furnace capable of receiving slabs directly from the caster, from a slab collection and storage area positioned adjacent the slab conveyor table exiting the continuous caster or from another area. A feed and run-out table is positioned at the exit end of the reheat furnace and inline with a hot reversing mill having a coiler furnace positioned on either side thereof. The mill must have the capability of reducing the cast slab to a thickness of about 1 inch or less in 3 flat passes. The combination coil, coiled plate, sheet in coil form or discrete plate finishing line extends inline and downstream of the hot reversing mill with its integral coiler furnaces. The finishing facilities include a cooling station, a down coiler, a plate table, a shear, a cooling bed crossover, a plate side and end shear and a piler.

To achieve the necessary balance between the hot reversing mill and the caster, it is necessary to produce slabs having a thickness between 3.5 inches to 5.5 inches, preferably between 3.75 inches to 4.5 inches, and most preferably to about 4 inches. The slabs are reduced to about 1 inch or less in 3 flat passes on the hot reversing mill before starting the coiling of the intermediate product between the coiler furnaces as it is further reduced to the desired finished product thickness. In order to provide the capability of making coiled plate, discrete plate and sheet in coil form up to 1000 PIW and higher, slab width may vary from 24 to 120 inches.

A preferred method of operation includes feeding a sheared or torch cut slab from the caster onto a slab table which either feeds directly into a reheat or equalizing furnace or into a slab collection and storage area adjacent to the slab table. The preferred method further includes feeding the slab directly into the furnace from the slab table. However, the method allows for the feeding of a previously collected and stored slab into the furnace for further processing.

DESCRIPTION OF THE PREFERRED EMBODIMENT

Figure 1:
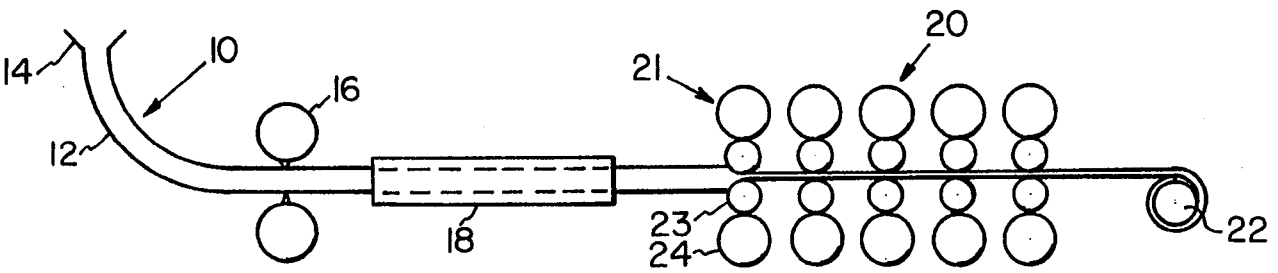
FIG. 1 PRIOR ART
FIG. 1 is a schematic of the prior art thin strip caster and continuous hot mill.

The prior art thin strip caster and inline continuous hot strip mill is illustrated in FIG. 1. The slab caster 10 consists of a curved trumpet mold 12 into which molten metal is fed through entry end 14. An electric furnace, the ladle station and the tundish (not shown) which feeds the continuous caster 10 are also conventional. The slab caster 10 casts a strand on the order of 2 inches or less which is cut into slabs of appropriate length by a shear or a torch cut 16 which is spaced an appropriate distance from the curved mold 12 to assure proper solidification before shearing. The thin slab then enters an elongated tunnel furnace 18 where the appropriate amount of thermal input takes place to insure that the slab is at the appropriate temperature throughout its mass for introduction into the continuous hot strip 20 located downstream of the tunnel furnace. The typical continuous hot strip 20 includes five roll stands 21 each consisting of a pair of work rolls 23 and a pair of backup rolls 24. Roll stands 21 are spaced and synchronized to continuously work the slab through all five roll stands. The resultant strip of the desired thickness is coiled on a downcoiler 22 and is thereafter further processed into the desired finished steel mill product.

The thin strip caster and continuous hot strip mill enjoy many advantages but have certain fundamental disadvantages, such as no room for error in that the continuous hot strip mill is directly integrated with the caster with no buffer therebetween to accommodate for operating problems in either the caster or the continuous hot strip mill.

Figure 3:
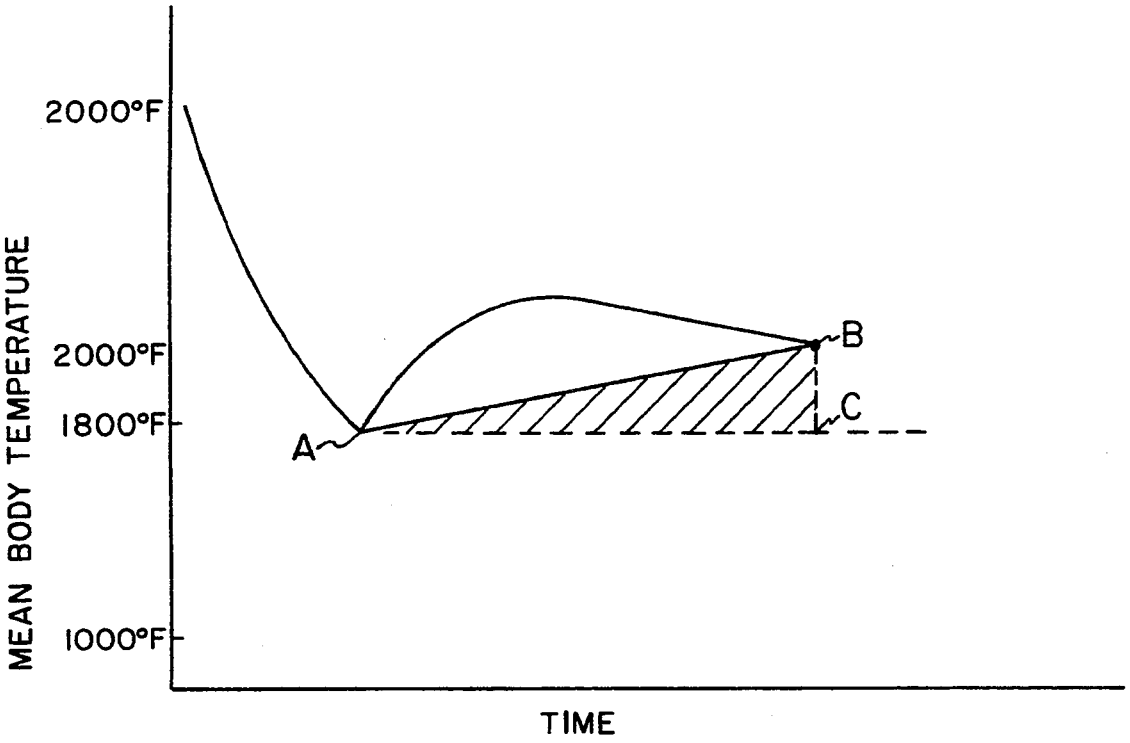
FIG. 3 is a time-temperature graph for a two inch thick slab from solidification to rolling.

In addition, the thermal decay is substantially greater for a two inch slab as compared to a four inch slab. This then requires a long tunnel furnace for the two inch slab to assure the appropriate rolling temperature. This is illustrated in FIG. 3 where the energy requirements expressed through a temperature-time curve for a two inch slab is illustrated. With a two inch thick cast slab, the mean body temperature of the as-cast slab is only 1750° F., which is too low a temperature to begin hot rolling. Since there is virtually no reservoir of thermal energy in the center of the slab due to its thin thickness, additional heat energy is required to attain the required mean body temperature of 2000° F. for hot rolling. Accordingly, since the thin slab is approximately 150 ft. long, it generally is heated in a long tunnel furnace. Such a furnace must provide the heat energy of approximately 120,000 BTU per ton to bring the steel up to a mean body temperature of 2000° F. for hot rolling and in addition, provide additional energy to establish the necessary heat gradient required to drive the heat energy into the slab in the time dictated by the two inch caster/rolling mill process.

Specifically, FIG. 3 represents the subject matter discussed above. FIG. 3 represents the energy required to heat a 2" slab to 2000° F. in a tunnel furnace. The area between points A and B under the curve represents the additional energy required to force the temperature of the slab to 2000° F. Further, point A is at 1750° F. and represents the mean body temperature of the slab prior to entering the tunnel furnace. Point B represents the 2000° F. rolling temperature. Additionally, the cross-hatched area between points A, B, and C represents the energy added to the slab (approximately 120,000 btu/-ton) to raise the mean body temperature.

In addition, while the two inch thick slab is travelling slowly through the tunnel furnace, the atmosphere of the furnace is forming "mill scale" on the exposed surface of the thin slab. This mill scale is detrimental to the quality of the finished sheet and most difficult to remove prior to rolling. Often the mill scale is rolled into the slab by the multistand continuous mill. Ordinarily, mill scale can be removed by the aggressive application of high pressure water sprays. However, with the two inch thick slab, such sprays will tend to quench the steel to an unacceptable temperature for rolling defeating the reheating process. On the other hand, the four inch slab is, of course, one half the length and has one half of the exposed surface and accordingly less of a build-up of scale. Further, this scale can be easily removed by the high pressure water sprays without affecting the slab temperature due to the reservoir of heat energy inside the four inch slab as discussed hereinafter.

As with the two inch thick slab, during the casting process external cooling is used to create a solid shell to contain the liquid core, which is essentially at the tundish temperature of 2800° F. As the shell builds up, the liquid core is consumed and the slab becomes solid through its thickness. This established the metallurgical length of the caster. For a four inch slab, there is a temperature gradient from the center of the slab (2800° to 2600° F.) to the surface, with a mean temperature of 2300° F., see FIG. 4. If the slab is now put into an isothermal enclosure, the high internal temperature gradient that was necessary to remove the solidification enthalpy, provides sufficient thermal energy to affect a mean slab body temperature of 2000° F. This equalization process, in the isothermal enclosure, is effected immediately after the cast slab has solidified and is cut to length prior to the entry into the furnace.

The time required to do this is determined by the square of the distance the heat must diffuse (at most, half the slab thickness) and the thermal diffusivity of the solidified mass. Because the mean body temperature before equalization was 2300° F. and the mean body temperature after equalization need only be 2000° F. to permit the steel to be hot rolled, there is an excess enthalpy of about 120,000 BTU's per ton of steel. This heat energy can be used to maintain the integrity of the isothermal enclosure, that is, compensate for losses associated with establishing the isothermal environment within the enclosure and accordingly, little or no external heating of the enclosure is required.

Figure 4:
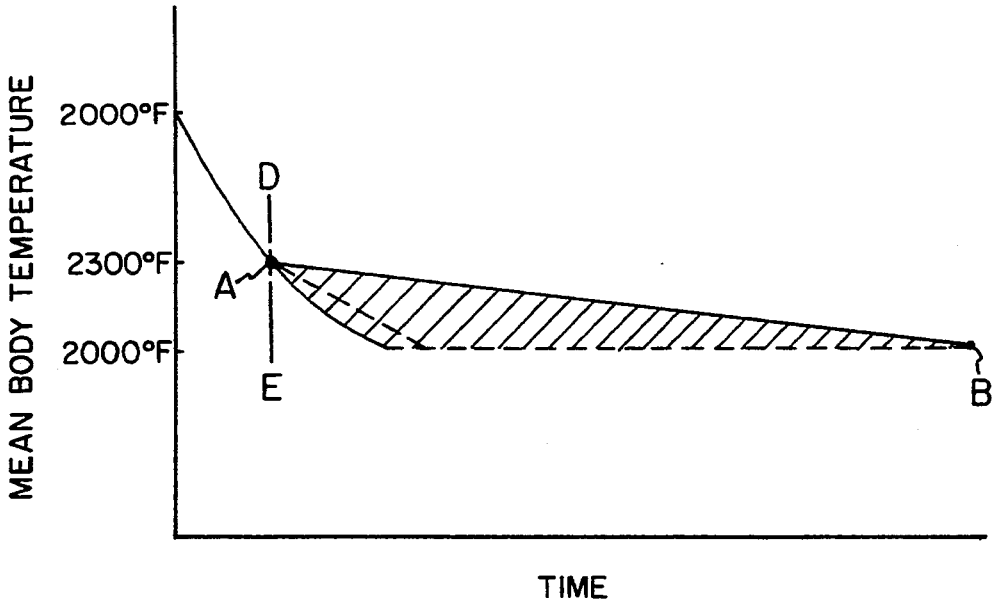
FIG. 4 is a time-temperature graph for a four inch thick slab from solidification to rolling.

FIG. 4 represents, in particular, the isothermal equalizing enclosure for a 4" thick slab for a rolling mill furnace. The line between points D and E represents entrance to the equalizing enclosure. Point A represents the 2300° F. mean body temperature and point B represents the 2000° F. rolling temperature. The line between points A and B represents the isothermal environment and the cross-hatched area represents the stored energy in a slab of approximately 120,000 btu/ton.

Figure 5:
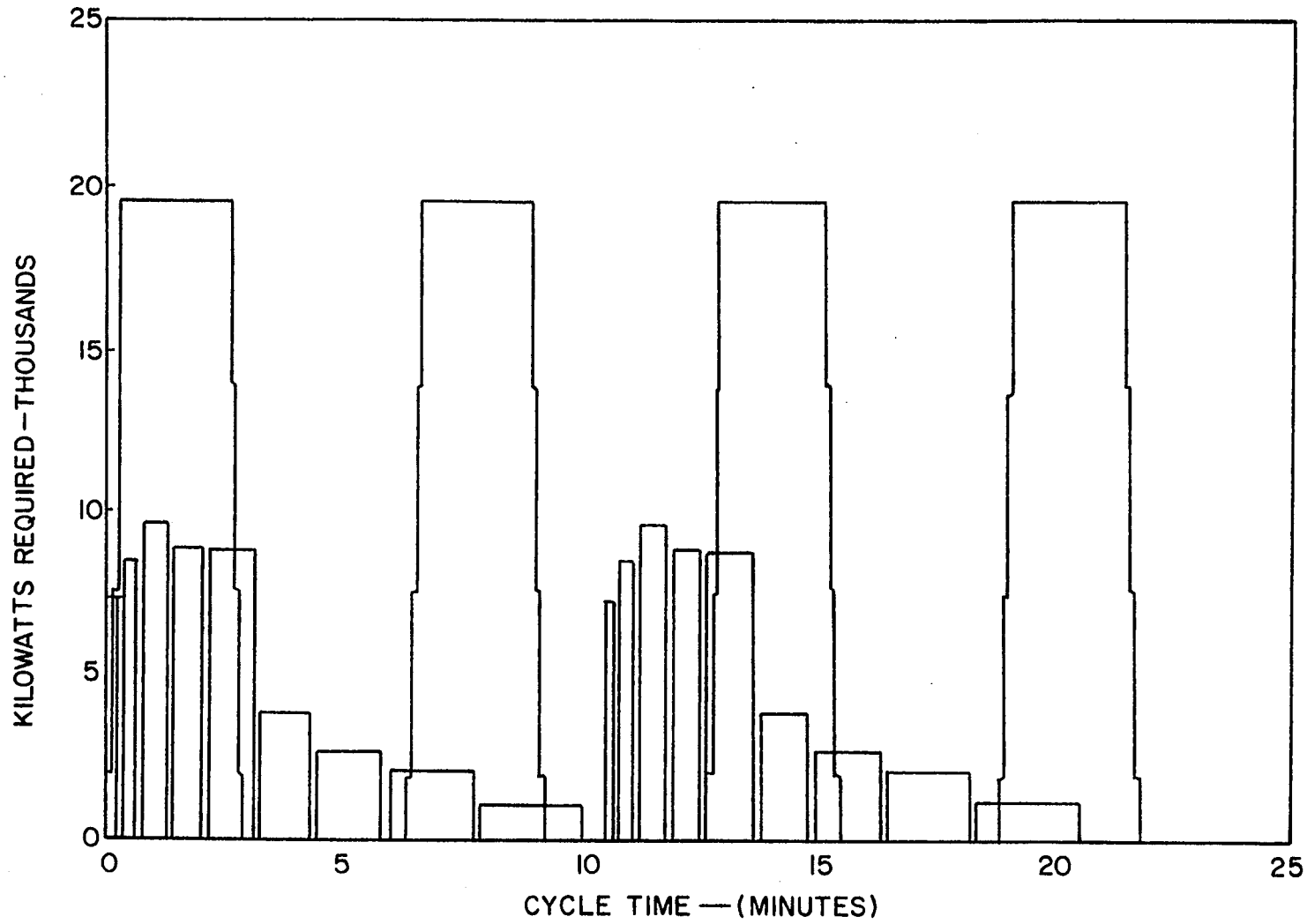
FIG. 5 is a bar chart comprising the peak power demands of the subject invention to a thin strip caster and continuous rolling mill.

One of the distinct advantages of this invention is the lower electric power costs of the subject invention as compared to the two inch thick caster/continuous rolling mill as previously described and similar processes. FIG. 5 illustrates this point by comparing the peak power surges (19000 kilowatts) of the multistand continuous rolling mill to the peak (9000 kilowatts) for the reversing mill of this invention. Since the power company's billing contract consists of two parts—"demand" and "consumed power", it is the "demand" portion that is the most costly when the process requires high peak loads over a short period of time. High demand equates to higher power costs. FIG. 5 illustrates four coils being rolled from a two inch slab at the high peak loads on a four stand finishing mill in about the same time it takes to roll two coils from a four inch slab at the lower peak loads on the hot reversing mill in nine passes each.

Additionally, and perhaps of more importance, is the fact that many power companies cannot provide for the high peak loads, as illustrated in FIG. 5, due to the limits of generator and line capacity. This is of particular concern to emerging countries where the power grids are weak and the transmission lines are long. This invention is directed to solving this problem, by providing emerging countries with a low capital cost productive mini mill steel plant compatible with their present power systems and existing infrastructure.

FIG. 5 represents, specifically, a comparison of peak rolling loads of 2" and 4" continuous cast slabs. The area underneath the four large cyclical peaks represents the kilowatts (in thousands) required for a multi stand continuous finishing mill with a slab of 2"×46.6"×148 ft.—1000 piw—rolled to 0.100" thick. The two sets of smaller peaks represent the kilowatts (in thousands) required for a hot reversing mill for a 4"×46.6"×75 ft.—1000 piw—rolled to 0.100" thick.

Even in sophisticated systems where demand gets averaged over say 15 minute intervals, the demand for a four or five stand continuous finishing mill receiving a two inch slab is still substantially greater than for a hot reversing mill receiving a four inch slab.

Figure 2:
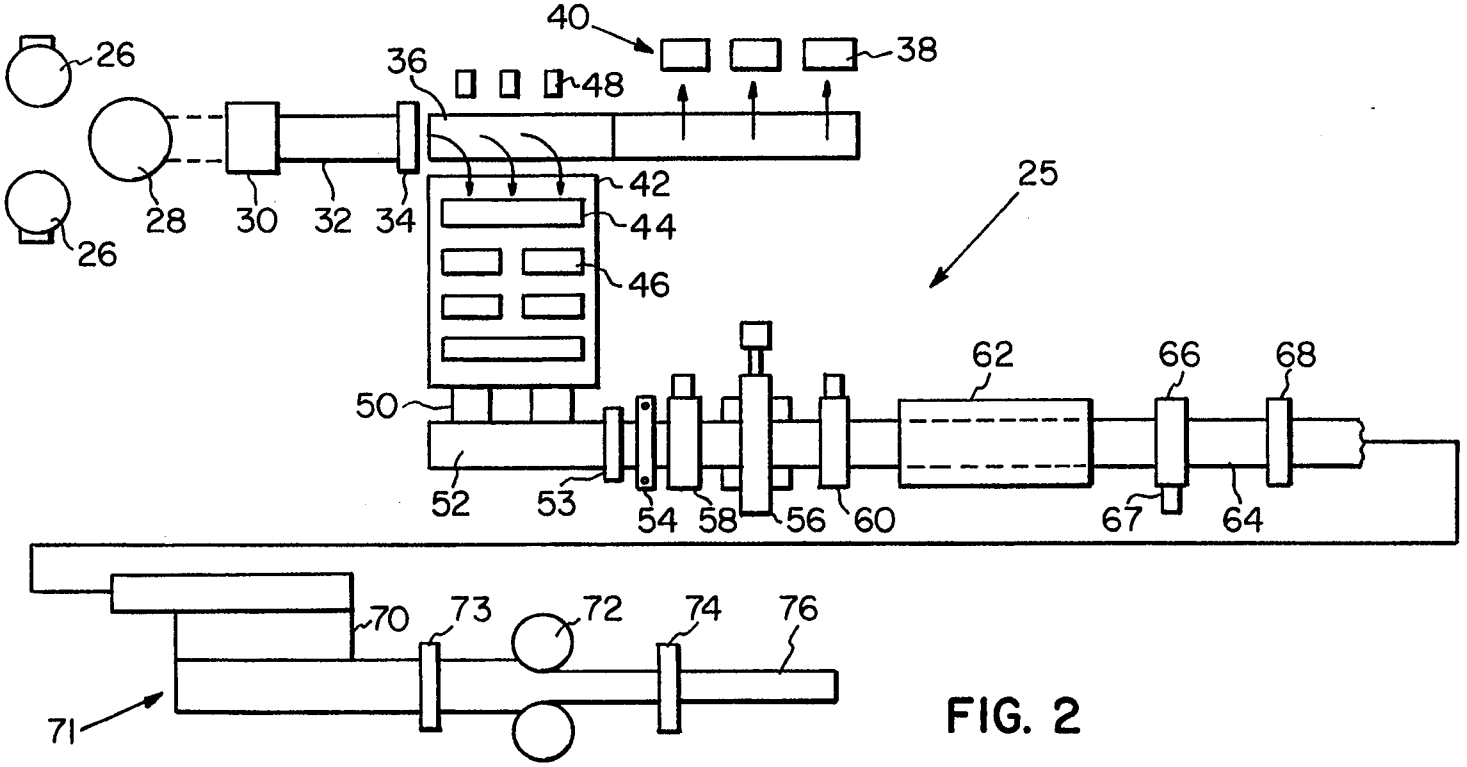
FIG. 2 is a schematic illustrating the intermediate thickness strip caster and inline hot reversing mill and coiler furnace arrangement.

The intermediate thickness slab caster and inline hot strip and plate line of the present invention is illustrated in FIG. 2. One or more electric melting furnaces 26 provide the molten metal at the entry end of our combination caster and strip and plate line 25. The molten metal is fed into a ladle furnace 28 prior to being fed into the caster 30. The caster 30 feeds into a mold (curved or straight) 32 of rectangular cross section.

A torch cutoff (or shear) 34 is positioned at the exit end of the mold 32 to cut the strand of now solidified metal into a 3.5 to 5.5 inch thick slab of the desired length which also has a width of 24 to 120 inches.

The slab then feeds on a table conveyor 36 to a slab takeoff area where it is directly charged into a furnace 42 or is removed from the inline processing and stored in a slab collection and storage area 40. The preferred furnace is of the walking beam type although a roller hearth furnace could also be utilized in certain applications. Full size slabs 44 and discrete length slabs 46 for certain plate products are shown within walking beam furnace 42. Slabs 38 which are located in the slab collection and storage area 40 may also be fed into the furnace 42 by means of slab pushers 48 or charging arm devices located for indirect charging of walking beam furnace 42 with slabs 38. It is also possible to charge slabs from other slab yards or storage areas. Because the intermediate thickness slabs retain heat to a much greater extent than the thin slabs, temperature equalization is all that is required in many modes of operation. Of course, where slabs are introduced from off line locations, the furnace must have the capacity to add BTU's to bring the slabs up to rolling temperatures.

The various slabs are fed through the furnace 42 in conventional manner and are removed by slab extractors 50 and placed on a feed and run back table 52. Descaler 53 and/or a vertical edger 54 can be utilized on the slabs. A vertical edger normally could not be used with a slab of only 2 inches or less.

Downstream of feed and run back table 52 and vertical edger 54 is a hot reversing mill 56 having an upstream and a downstream coiler furnace 58 and 60, respectively. Cooling station 62 is downstream of coiler furnace 60. Downstream of cooling station 62 is a coiler 66 operated in conjunction with a coil car 67 followed by a plate table 64 operated in conjunction with a shear 68. The final product is either coiled on coiler 66 and removed by coil car 67 as sheet in strip or coil plate form or is sheared into plate form for further processing inline. A plate product is transferred by transfer table 70 which includes a cooling bed onto a final processing line 71. The final processing line 71 includes a plate side shear 72, plate end shear 74 and plate piler 76.

The advantages of the subject invention come about as the result of the operating parameters employed. The cast strand should have a thickness between 3.5 inches to 5.5 inches, preferably between 3.75 inches to 4.5 inches and most preferably to about 4 inches thick. The width can generally vary between 24 inches and 100 inches to produce a product up to 1000 PIW and higher.

The slab after leaving walking beam furnace 42 is flat passed back and forth through hot reversing mill 56 in no more than three passes achieving a slab thickness of about 1 inch or less. The intermediate product is then coiled in the appropriate coiler furnace, which in the case of three flat passes would be downstream coiler furnace 60. Thereafter, the intermediate product is passed back and forth through hot reversing mill 56 and between the coiler furnaces to achieve the desired thickness for the sheet in coil form, the coil plate or the plate product. The number of passes to achieve the final product thickness may vary but normally may be done in nine passes which include the initial flat passes. On the final pass, which normally originates from upstream toiler furnace 58, the strip of the desired thickness is rolled in the hot reversing mill and continues through the cooling station 62 where it is appropriately cooled for coiling on a coiler 66 or for entry onto a plate table 64. If the product is to be sheet or plate in coil form, it is coiled on coiler 66 and removed by coil car 67. If it is to go directly into plate form, it enters plate table 64 where it is sheared by shear 68 to the appropriate length. The plate thereafter enters a transfer table 70 which acts as a cooling bed so that the plate may be finished on finishing line 71 which includes descaler 73, side shear 72, end shear 74 and piler 76.

The following Examples illustrate the wide range of products that can be produced. It should be noted that the entry temperature into the rolling mill is necessarily higher (2300° F.) for the wider slabs than for the more narrow product widths (about 2000° F.) which more narrow widths in most facilities would represent the bulk of the product requirements.

EXAMPLE 1

A 74 inch wide×0.100 inch thick sheet in coil form is produced from a 4 inch slab of low carbon steel in accordance with the following rolling schedule:

EXAMPLE 1
37.193 tons 1005.PIW
Rolling Schedule HSM - 74.00–4.0000/.1000

| Mill Stand Name | Gauge in. | % Red | Draft in. | Bite Angle Deg. | Length ft. | Strip Speed FPM | Elapsed Time sec. |
|---|---|---|---|---|---|---|---|
| FCE: | 4.0000 | .0 | .0000 | .00 | 74.00 | .0 | .00 |
| CM1: | 2.6000 | 35.0 | 1.4000 | 17.57 | 113.85 | 628.0 | 15.88 |
| CM2: | 1.5000 | 42.3 | 1.1000 | 15.56 | 197.33 | 628.0 | 39.73 |
| CM3: | .8000 | 46.7 | .7000 | 12.40 | 370.00 | 628.0 | 81.65 |
| CM4: | .4518 | 43.5 | .3482 | 8.74 | 655.15 | 700.0 | 144.56 |
| CM5: | .2888 | 36.1 | .1630 | 5.98 | 1024.84 | 950.0 | 216.66 |
| CM6: | .2000 | 30.8 | .0889 | 4.41 | 1480.22 | 1300.0 | 293.23 |
| CM7: | .1467 | 26.6 | .0533 | 3.42 | 2017.95 | 1500.0 | 382.69 |
| CM8: | .1170 | 20.2 | .0297 | 2.55 | 2529.91 | 1500.0 | 492.64 |
| CM9: | .1000 | 14.5 | .0170 | 1.93 | 2960.00 | 1500.0 | 611.04 |

| Mill Stand Name | Gauge in. | Entry Temp. Deg. F. | Exit Temp. Deg. F. | Roll Force lb × 10**6 | Torque lb-ft × 10**6 | Horse Power | Load Ratio | RMS Time sec. |
|---|---|---|---|---|---|---|---|---|
| FCE: | 4.0000 | 2300.00 | 2300.00 | .0000 | .0000 | 0. | .0000 | .00 |
| CM1: | 2.6000 | 2239.67 | 2241.03 | 4.1612 | 1.5802 | 24058. | 2.0049 | 43.72 |
| CM2: | 1.5000 | 2193.75 | 2201.54 | 4.6819 | 1.5727 | 23944. | 1.9953 | 75.06 |
| CM3: | .8000 | 2082.49 | 2084.68 | 5.4107 | 1.4435 | 21978. | 1.8315 | 123.84 |
| CM4: | .4518 | 2048.25 | 2057.04 | 4.8229 | .8998 | 15269. | 1.2724 | 93.76 |
| CM5: | .2888 | 2012.50 | 1998.60 | 4.0827 | .5142 | 11843. | .9869 | 65.36 |
| CM6: | .2000 | 1955.96 | 1957.08 | 3.5959 | .3288 | 10364. | .8637 | 53.39 |
| CM7: | .1467 | 1914.11 | 1911.34 | 3.3138 | .2299 | 8360. | .6967 | 41.00 |
| CM8: | .1170 | 1865.15 | 1854.39 | 2.7717 | .1400 | 5092. | .4243 | 18.90 |
| CM9: | .1000 | 1807.26 | 1790.20 | 2.2795 | .0846 | 3076. | .2563 | 7.78 |

Distance/Length Ratio: .5000
Combination Mill RMS Production: 219.126 TPH
Combination Mill Peak Production: 219.126 TPH
Coiling Begins at Pass Number: 3 *CM3*
Distance Between CFce #1 and Mill: 25.00 ft.
Distance Between Mill and CFce #2: 25.00 ft.
Coiling Furnace Diameter: 54.00 in.
Coiling Furnace Temperature: 1750.00 Deg. F.
Acceleration/Deceleration Rate: 200.00 FPM/sec
Final Body Temperature at TS: 1790.20 Deg. F.

EXAMPLE 2

A 52 inch wide×0.100 inch thick sheet in coil form is produced from a 4 inch slab of low carbon steel in accordance with the following rolling schedule:

EXAMPLE 2
23.513 tons 1009.PIW
Rolling Schedule HSM - 46.61–3.9370/.1063

| Mill | Bite | Strip | Elapsed |
|---|---|---|---|

-continued

EXAMPLE 2
23.513 tons 1009.PIW
Rolling Schedule HSM - 46.61-3.9370/.1063

| Stand Name | Gauge in. | % Red | Draft in. | Angle Deg. | Length ft. | Speed FPM | Time sec. |
|---|---|---|---|---|---|---|---|
| FCE: | 3.9370 | .0 | .0000 | .00 | 75.46 | .0 | .00 |
| CM1: | 2.7559 | 30.0 | 1.1811 | 16.13 | 107.80 | 472.4 | 18.69 |
| CM2: | 1.7520 | 36.4 | 1.0039 | 14.87 | 169.57 | 524.9 | 43.07 |
| CM3: | 1.0000 | 42.9 | .7520 | 12.86 | 297.08 | 590.6 | 78.71 |
| CM4: | .5512 | 44.9 | .4488 | 9.92 | 539.00 | 738.2 | 128.08 |
| CM5: | .3091 | 43.9 | .2421 | 7.28 | 961.27 | 984.3 | 192.43 |
| CM6: | .2122 | 31.3 | .0968 | 4.60 | 1399.83 | 1312.3 | 262.43 |
| CM7: | .1599 | 24.6 | .0523 | 3.38 | 1857.70 | 1312.3 | 353.36 |
| CM8: | .1251 | 21.8 | .0349 | 2.76 | 2375.57 | 1312.3 | 467.97 |
| CM9: | .1063 | 15.0 | .0188 | 2.03 | 2794.79 | 1312.3 | 595.75 |

| Mill Stand Name | Gauge in. | Entry Temp. Deg. F. | Exit Temp. Deg. F. | Roll Force lb × 10**6 | Torque lb-ft × 10**6 | Horse Power | Load Ratio | RMS Time sec. |
|---|---|---|---|---|---|---|---|---|
| FCE: | 3.9370 | 2012.00 | 2012.00 | .0000 | .0000 | 0. | .0000 | .00 |
| CM1: | 2.7559 | 2003.49 | 1999.79 | 2.7608 | 1.1177 | 12801. | 1.4175 | 27.51 |
| CM2: | 1.7520 | 1963.98 | 1958.37 | 2.6782 | .9484 | 12069. | 1.2027 | 28.04 |
| CM3: | 1.0000 | 1888.64 | 1893.34 | 2.9541 | .8209 | 11752. | 1.0411 | 33.20 |
| CM4: | .5512 | 1878.14 | 1884.83 | 3.3990 | .7251 | 12976. | 1.0809 | 51.84 |
| CM5: | .3091 | 1864.68 | 1870.62 | 3.5767 | .5536 | 13210. | 1.1004 | 71.86 |
| CM6: | .2122 | 1847.80 | 1843.65 | 2.5327 | .2436 | 7749. | .6455 | 27.08 |
| CM7: | .1599 | 1818.39 | 1805.02 | 2.0859 | .1445 | 4598. | .3830 | 12.60 |
| CM8: | .1251 | 1776.58 | 1757.60 | 2.0196 | .1113 | 3542. | .2950 | 9.54 |
| CM9: | .1063 | 1728.86 | 1701.74 | 1.4785 | .0582 | 1851. | .1542 | 3.04 |

Distance/Length Ratio: .5000
Combination Mill RMS Production: 142.086 TPH
Combination Mill Peak Production: 142.086 TPH
Coiling Begins at Pass Number: 3 *CM3*
Distance Between CFce #1 and Mill: 20.01 ft.
Distance Between Mill and CFce #2: 20.01 ft.
Coiling Furnace Diameter: 48.00 in.
Coiling Furnace Temperature: 1742.00 Deg. F.
Acceleration/Deceleration Rate: 656.17 FPM/sec
Final Body Temperature at TS: 1701.74 Deg. F.

EXAMPLE 3

A 98 inch wide × nominal 0.187 inch thick coil plate is produced from a 4 inch slab of low carbon steel to an actual thickness of 0.177 inch in accordance with the following rolling schedule:

EXAMPLE 3
49.256 tons 1005.PIW
Rolling Schedule HSM - 98.00-4.0000/.1770

| Mill Stand Name | Gauge in. | % Red | Draft in. | Bite Angle Deg. | Length ft. | Strip Speed FPM | Elapsed Time sec. |
|---|---|---|---|---|---|---|---|
| FCE: | 4.0000 | .0 | .0000 | .00 | 74.00 | .0 | .00 |
| CM1: | 2.8500 | 28.8 | 1.1500 | 15.92 | 103.86 | 628.0 | 14.92 |
| CM2: | 1.9000 | 33.3 | .9500 | 14.46 | 155.79 | 628.0 | 34.81 |
| CM3: | 1.2000 | 36.8 | .7000 | 12.40 | 246.67 | 628.0 | 63.37 |
| CM4: | .8000 | 33.3 | .4000 | 9.37 | 370.00 | 700.0 | 101.84 |
| CM5: | .4950 | 39.4 | .3150 | 8.31 | 610.31 | 700.0 | 160.90 |
| CM6: | .3377 | 30.4 | .1473 | 5.68 | 876.52 | 1300.0 | 209.61 |
| CM7: | .2528 | 25.1 | .0849 | 4.31 | 1170.96 | 1500.0 | 265.19 |
| CM8: | .2040 | 19.3 | .0488 | 3.27 | 1450.98 | 1500.0 | 331.98 |
| CM9: | .1770 | 13.2 | .0270 | 2.43 | 1672.32 | 1500.0 | 398.88 |

| Mill Stand Name | Gauge in. | Entry Temp. Deg. F. | Exit Temp. Deg. F. | Roll Force lb × 10**6 | Torque lb-ft × 10**6 | Horse Power | Load Ratio | RMS Time sec. |
|---|---|---|---|---|---|---|---|---|
| FCE: | 4.0000 | 2300.00 | 2300.00 | .0000 | .0000 | 0. | .0000 | .00 |
| CM1: | 2.8500 | 2241.17 | 2240.50 | 4.6775 | 1.6096 | 24506. | 2.0422 | 41.38 |
| CM2: | 1.9000 | 2202.69 | 2206.31 | 5.0558 | 1.5789 | 24038. | 2.0032 | 59.73 |
| CM3: | 1.2000 | 2134.00 | 2132.39 | 5.5481 | 1.4833 | 22583. | 1.8819 | 83.47 |
| CM4: | .8000 | 1998.94 | 2004.54 | 5.5314 | 1.1128 | 18884. | 1.5737 | 82.87 |
| CM5: | .4850 | 1976.56 | 1971.51 | 6.4793 | 1.1498 | 19513. | 1.6261 | 142.95 |
| CM6: | .3377 | 1943.25 | 1948.71 | 4.8974 | .5877 | 18523. | 1.5436 | 104.13 |
| CM7: | .2528 | 1923.51 | 1924.19 | 4.1044 | .3694 | 13435. | 1.1196 | 63.41 |
| CM8: | .2040 | 1895.94 | 1890.14 | 3.3006 | .2221 | 8077. | .6731 | 28.00 |

-continued

EXAMPLE 3
49.256 tons 1005.PIW
Rolling Schedule HSM - 98.00–4.0000/.1770

| | | | | | | | | |
|---|---|---|---|---|---|---|---|---|
| CM9: | .1770 | 1859.62 | 1848.11 | 2.4641 | .1216 | 4422. | .3685 | 9.09 |

Distance/Length Ratio: .5000
Combination Mill RMS Production: 288.317 TPH
Combination Mill Peak Production: 444.550 TPH
Coiling Begins at Pass Number: 4 *CM4*
Distance Between CFce #1 and Mill: 25.00 ft.
Distance Between Mill and CFce #2: 25.00 ft.
Coiling Furnace Diameter: 54.00 in.
Coiling Furnace Temperature: 1750.00 Deg. F.
Acceleration/Deceleration Rate: 200.00 FPM/sec
Final Front Temperature at TS: 1848.11 Deg. F.

EXAMPLE 4

An 84 inch wide×0.140 inch thick coil plate is produced from a 4 inch slab of low carbon steel in accordance with the following rolling schedule:

EXAMPLE 4
42.219 tons 1005.PIW
Rolling Schedule HSM - 84.00–4.0000/.1400

| Mill Stand Name | Gauge in. | % Red | Draft in. | Bite Angle Deg. | Length ft. | Strip Speed FPM | Elapsed Time sec. |
|---|---|---|---|---|---|---|---|
| FCE: | 4.0000 | .0 | .0000 | .00 | 74.00 | .0 | .00 |
| CM1: | 2.7050 | 32.4 | 1.2950 | 16.36 | 109.43 | 628.0 | 15.45 |
| CM2: | 1.7000 | 37.2 | 1.0050 | 14.40 | 174.12 | 628.0 | 37.09 |
| CM3: | 1.0000 | 41.2 | .7000 | 12.01 | 296.00 | 628.0 | 71.94 |
| CM4: | .5910 | 40.9 | .4090 | 9.17 | 500.82 | 700.0 | 121.62 |
| CM5: | .3876 | 34.4 | .2034 | 6.46 | 763.63 | 950.0 | 177.22 |
| CM6: | .2733 | 29.5 | .1143 | 4.84 | 1082.95 | 1300.0 | 235.45 |
| CM7: | .2032 | 25.6 | .0701 | 3.79 | 1456.45 | 1500.0 | 302.46 |
| CM8: | .1600 | 21.3 | .0432 | 2.98 | 1850.00 | 1500.0 | 385.21 |
| CM9: | .1400 | 12.5 | .0200 | 2.03 | 2114.29 | 1500.0 | 469.78 |

| Mill Stand Name | Gauge in. | Entry Temp. Deg. F. | Exit Temp. Deg. F. | Roll Force lb × 10**6 | Torque lb-ft × 10**6 | Horse Power | Load Ratio | RMS Time sec. |
|---|---|---|---|---|---|---|---|---|
| FCE: | 4.0000 | 2300.00 | 2300.00 | .0000 | .0000 | 0. | .0000 | .00 |
| CM1: | 2.7050 | 2240.37 | 2240.88 | 4.6421 | 1.7504 | 24985. | 2.2213 | 51.59 |
| CM2: | 1.7000 | 2198.43 | 2203.75 | 4.9834 | 1.6522 | 23582. | 2.0966 | 73.12 |
| CM3: | 1.0000 | 2111.30 | 2111.30 | 5.6252 | 1.5509 | 22137. | 1.9681 | 115.63 |
| CM4: | .5910 | 2081.04 | 2088.19 | 5.3408 | 1.1183 | 17792. | 1.4826 | 98.21 |
| CM5: | .3876 | 2051.80 | 2041.50 | 4.5043 | .6583 | 14214. | 1.1845 | 71.00 |
| CM6: | .2733 | 2006.29 | 2007.07 | 3.9160 | .4236 | 12515. | 1.0429 | 57.90 |
| CM7: | .2032 | 1971.36 | 1968.75 | 3.5466 | .2958 | 10085. | .8404 | 43.79 |
| CM8: | .1600 | 1929.28 | 1921.25 | 3.1563 | .2030 | 6922. | .5768 | 25.87 |
| CM9: | .1400 | 1879.66 | 1863.49 | 2.0924 | .0896 | 3055. | .2546 | 5.48 |

Distance/Length Ratio: .5000
Combination Mill RMS Production: 280.116 TPH
Combination Mill Peak Production: 323.529 TPH
Coiling Begins at Pass Number: 3 *CM3*
Distance Between CFce #1 and Mill: 25.00 ft.
Distance Between Mill and CFce #2: 25.00 ft.
Coiling Furnace Diameter: 54.00 in.
Coiling Furnace Temperature: 1750.00 Deg. F.
Acceleration/Deceleration Rate: 200.00 FPM/sec
Final Body Temperature at TS: 1863.49 Deg. F.

The intermediate thickness continuous caster and hot strip and plate line provide many of the advantages of the thin strip caster without the disadvantages. The basic design of the facility can be predicated on rolling 150 tons per hour on the rolling mill. The market demand will obviously dictate the product mix, but for purposes of calculating the required caster speeds to achieve 150 tons per hour of rolling, one can assume the bulk of the product mix will be between 36 inches and 72 inches. A 72 inch slab rolled at 150 tons per hour would require a casting speed of 61 inches per minute. At 60 inches of width, the casting speed increases to 73.2 inches per minute; at 48 inches, the casting speed increases to 91.5 inches per minute; and at 36 inches of width, the casting speed increases to 122 inches per minute. All of these speeds are within acceptable casting speeds.

The annual design tonnage can be based on 50 weeks of operation per year at 8 hours a turn and 15 turns per week for 6000 hours per year of available operating time assuming that 75% of the available operating time is utilized and assuming a 96% yield through the operating facility, the annual design tonnage will be approximately 650,000 finished tons.

We claim:

1. A method of making coiled plate, sheet in coil form or discrete plate comprising the steps of:

a) continuously casting a strand having a thickness between about 3.5 inches to about 5.5 inches;

b) shearing said strand into a slab of predetermined length;

c) feeding the slab into an inline heating furnace;

d) extracting said slab onto a continuous processing line including a hot reversing mill having a coiler furnace on each of an upstream side and downstream side thereof;

e) flat passing said slab back and forth through said mill to form an intermediate product of a thickness sufficient for coiling after a minimum number of said flat passes through the mill;

f) coiling said intermediate product in one of said upstream or downstream coiler furnaces;

g) passing said coiled intermediate product back and forth through said mill to reduce said coiled intermediate product to an end product of desired thickness, said intermediate product being collected in and fed out of each of said coiler furnaces on each pass through the mill; and h) finishing said end product into one of coiled plate, discrete plate or sheet in coil form.

2. The method of claim 1 further comprising the step of removing slabs from a slab takeoff located downstream of the caster and adjacent said heating furnace when delays are encountered downstream of the furnace and storing said slabs in a storage area upstream of the furnace prior to charging said slabs into said furnace.

3. The method of claim 1 further comprising the step of passing said slab through a vertical edger prior to flat passing said slab.

4. The method of claim 1 including casting a strand to a thickness between 3.75 inches to 4.5 inches.

5. The method of claim 1 including casting a strand to a thickness of about 4 inches.

6. The method of claim 1 including reducing said intermediate product to said end product in six or less passes through said hot reversing mill.

7. The method of claim 1 wherein said finishing of said end product includes cooling said end product by passing it through an inline cooling station and thereafter coiling it on an inline down coiler for removal as coiled plate or sheet in coil form.

8. The method of claim 1 wherein said finishing of said end product includes shearing inline to a plate of a discrete length, cooling said plate and finishing said plate through at least one of a side shear and end shear and a piler.

9. The method of claim 1 including casting a strand having a width between 24 inches and 120 inches

10. The method of claim 1 wherein said minimum number of passes comprises two passes from said upstream side coiler to said downstream side coiler and at least one pass from said downstream side coiler to said upstream side coiler.

11. The method of claim 1 wherein four said flat passes form said intermediate product of less than 1 inch in thickness.

12. The method of claim 1 wherein three said flat passes form said intermediate product of about 1 inch or less in thickness.

13. An intermediate thickness slab caster and inline hot strip and plate line comprising:

a) a continuous strip caster means for forming a strand of about 3.5 inches to about 5.5 inches thick;

b) an inline shear downstream of said caster means for cutting said strand to a slab of a desired length;

c) a slab conveyor table inline with said shear and including a slab takeoff operable transverse of said conveyor table;

d) a slab collection and storage area adjacent the slab conveyor table adapted to receive slabs from said slab takeoff;

e) a reheat furnace having an entry end inline with said slab conveyor table and said slab collection and storage area for receiving slabs from either;

f) a feed and run back table positioned at an exit end of said reheat furnace;

g) a hot reversing mill means inline with said feed and run back table for reducing said slab exiting the reheat furnace to an intermediate thickness product of a thickness sufficient for coiling in a minimum number of flat passes;

h) a pair of coiler furnaces, one located upstream of said hot reversing mill means and the other located downstream, said coiler furnaces capable of receiving and paying out said intermediate thickness product as it is passed between the coiler furnaces and through said hot reversing mill means so as to be reduced to an end product thickness; and i) a finishing line downstream of and inline with said pair of coiler furnaces and said hot reversing mill means.

14. The apparatus of claim 13 wherein said finishing line includes in sequence a cooling station, a downcoiler, a plate table, a shear, a cooling bin crossover and plate side and end shears and a piler.

15. The apparatus of claim 13 wherein said hot reversing mill is configured to reduce said slab exiting the reheat furnace to an intermediate coiling thickness in two flat passes from said upstream side coiler to said downstream side coiler and at least one flat pass from said downstream side coiler to said upstream side coiler.

* * * * *